US006814143B2

(12) United States Patent
Braddick

(10) Patent No.: US 6,814,143 B2
(45) **Date of Patent: *Nov. 9, 2004**

(54) DOWNHOLE TUBULAR PATCH, TUBULAR EXPANDER AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/215,167

(22) Filed: Aug. 8, 2002

(65) Prior Publication Data

US 2003/0102127 A1 Jun. 5, 2003

Related U.S. Application Data

(63) Continuation-in-part of application No. 09/998,810, filed on Nov. 30, 2001, now Pat. No. 6,622,789.

(51) Int. Cl.[7] ..... E21B 23/00; E21B 33/13

(52) U.S. Cl. ..... 166/277; 166/206; 166/207; 166/212

(58) Field of Search ..... 166/277, 206, 166/207, 212, 243

(56) References Cited

U.S. PATENT DOCUMENTS

| | | | | |
|---|---|---|---|---|
| 3,179,168 A | | 4/1965 | Vincent | |
| 3,245,471 A | | 4/1966 | Howard | |
| 3,358,760 A | | 12/1967 | Blagg | |
| 3,412,565 A | * | 11/1968 | Lindsey et al. | 405/231 |
| 3,746,091 A | * | 7/1973 | Owen et al. | 166/107 |
| 3,776,307 A | * | 12/1973 | Young | 166/125 |
| 3,948,321 A | * | 4/1976 | Owen et al. | 166/277 |
| 4,862,957 A | * | 9/1989 | Scranton | 166/51 |
| 5,069,280 A | * | 12/1991 | McKee et al. | 166/278 |
| 5,333,692 A | | 8/1994 | Baugh et al. | |
| 5,348,095 A | | 9/1994 | Worrall et al. | |
| 5,366,012 A | | 11/1994 | Lohbeck | |
| 5,390,742 A | | 2/1995 | Dines et al. | |
| 5,494,106 A | | 2/1996 | Gueguen et al. | |
| 5,667,011 A | | 9/1997 | Gill et al. | |
| 5,785,120 A | | 7/1998 | Smalley et al. | |
| 6,012,523 A | * | 1/2000 | Campbell et al. | 166/277 |
| 6,021,850 A | | 2/2000 | Wood et al. | |
| 6,029,748 A | * | 2/2000 | Forsyth et al. | 166/380 |
| 6,041,858 A | | 3/2000 | Arizmendi | |
| 6,050,341 A | | 4/2000 | Metcalf | |
| 6,098,717 A | * | 8/2000 | Bailey et al. | 166/382 |
| 6,250,385 B1 | | 6/2001 | Montaron | |
| 6,425,444 B1 | * | 7/2002 | Metcalfe et al. | 166/387 |
| 6,478,091 B1 | * | 11/2002 | Gano | 166/373 |
| 6,622,789 B1 | * | 9/2003 | Braddick | 166/277 |

FOREIGN PATENT DOCUMENTS

WO WO 00/26502 * 10/1999

OTHER PUBLICATIONS

2001 Publication No. 2001/0020532A1.

* cited by examiner

*Primary Examiner*—Hoang Dang
(74) *Attorney, Agent, or Firm*—Loren G. Helmreich; Browning Bushman, P.C.

(57) ABSTRACT

A system for forming a patch in a well at a location along a tubular string which has lost sealing integrity includes a central patch body 60, an upper expander body 52 carrying an upper seal 50 or 56, and a lower expander body 98 carrying a lower seal 102, 104. The running tool includes an inner mandrel 14 axially moveable relative to the central patch body, and one or more pistons 20, 30, 20A axially moveable relative to the inner mandrel in response to fluid pressure within the running tool. Top expander 48 is axially moveable downward relative to the upper expander body in response to movement of the one or more pistons. The expander sleeves may remain downhole to radially support the downhole tubular.

41 Claims, 11 Drawing Sheets

DOWNHOLE TUBULAR PATCH, TUBULAR EXPANDER AND METHOD

RELATED APPLICATION

This application is a continuation-in-part of U.S. Ser. No. 09/998,810 filed Nov. 30, 2001, now U.S. Pat. No. 6,622,789.

FIELD OF THE INVENTION

The present invention relates to downhole tools and techniques used to radially expand a downhole tubular into sealing engagement with a surrounding tubular. More particularly, this invention relates to a technique for forming a downhole tubular patch inside a perforated or separated tubular utilizing a conventional interior tubular and a tool which forms an upper seal and a lower seal above and below the region of the perforation or separation. The invention also involves a tubular expander for expanding a downhole tubular, and a patch installation and tubular expander method.

BACKGROUND OF THE INVENTION

Oil well operators have long sought improved techniques for forming a downhole patch across a tubular which has lost sealing integrity, whether that be due to a previous perforation of the tubular, high wear of the tubular at a specific downhole location, or a complete separation of the tubular. Also, there are times when a screened section of a tubular needs to be sealed off. A tubular patch with a reduced throughbore may then be positioned above and below the zone of the larger diameter tubular which lost its sealing integrity, and the reduced diameter tubular then hung off from and sealed at the top and bottom to the outer tubular. In some applications, the patch may be exposed to high thermal temperatures which conventionally reduce the effectiveness of the seal between the tubular patch and the outside tubular. In heavy oil recovery operations, for instance, steam may be injected for several days, weeks or months through the tubular, downward past the patch, and then into a formation.

U.S. Pat. No. 5,348,095 to Shell Oil Company discloses a method of expanding a casing diameter downhole utilizing a hydraulic expansion tool. U.S. Pat. No. 6,021,850 discloses a downhole tool for expanding one tubular against a larger tubular or the borehole. Publication U.S. 2001/0020532 A1 discloses a tool for hanging a liner by pipe expansion. U.S. Pat. No. 6,050,341 discloses a running tool which creates a flow restriction and a retaining member moveable to a retracted position to release by the application of fluid pressure.

Due to problems with the procedure and tools used to expand a smaller diameter tubular into reliable sealing engagement with a larger diameter tubular, many tools have avoided expansion of the tubular and used radially expandable seals to seal the annulus between the small diameter and the large diameter tubular, as disclosed U.S. Pat. No. 5,333,692. Other patents have suggested using irregularly shaped tubular members for the expansion, as disclosed in U.S. Pat. Nos. 3,179,168, 3,245,471, 3,358,760, 5,366,012, 5,494,106, and 5,667,011. U.S. Pat. No. 5,785,120 discloses a tubular patch system with a body and selectively expandable members for use with a corrugated liner patch. U.S. Pat. No. 6,250,385 discloses an overlapping expandable liner. A sealable perforating nipple is disclosed in U.S. Pat. No. 5,390,742, and a high expansion diameter packer is disclosed in U.S. Pat. No. 6,041,858.

Various tools and methods have been proposed for expanding an outer tubular while downhole, utilizing the hydraulic expansion tool. While some of these tools have met with limited success, a significant disadvantage to these tools is that, if a tool is unable to continue its expansion operation (whether due to the characteristics of a hard formation about the tubular, failure of one or more tool components, or otherwise) it is difficult and expensive to retrieve the tool to the surface to either correct the tool or to utilize a more powerful tool to continue the downhole tubular expansion operation. Accordingly, various techniques have been developed to expand a downhole tubular from the top down, rather than from the bottom up, so that the tool can be easily retrieved from the expanded diameter bore, and the repaired or revised tool then inserted into the lower end of the expanded tubular.

The disadvantages of the prior art are overcome by the present invention, and an improved system for forming a patch in a well and a location along the downhole tubular string which has lost sealing integrity is hereafter disclosed. The system includes a tubular patch with a central patch body, an upper expander body, and a lower expander body, and a running tool with a top expander and a bottom expander to move the tubular patch into sealing engagement with the downhole tubular string. The present invention also discloses a tubular expansion running tool and method which may be reliably used to expand a downhole tubular while facilitating retrieval of the tool and subsequently reinsertion of the tool through the restricted diameter downhole tubular.

SUMMARY OF THE INVENTION

A system for forming a patch in a well includes a tubular patch for positioning within the downhole tubular string at a location that has lost sealing integrity. The tubular patch is supported on a running tool suspended in the well from a work string. The tubular patch includes a central patch body having a generally cylindrical central interior surface, an upper expander body having a generally cylindrical upper interior surface and an upper exterior seal, and a lower expander body having a generally cylindrical lower interior surface and a lower exterior seal. The tubular patch may also include an expansion joint positioned between the upper expander body and the lower expander body to compensate for expansion and contraction of the tubular patch caused by thermal variations between the tubular patch and the tubular string exterior of the patch. The running tool includes an inner mandrel that is axially movable relative to the central patch body, and one or more pistons each axially movable relative to the inner mandrel in response to fluid pressure within the running tool. A top expander is axially moveable downward relative to the upper expander body in response to axial movement of one or more pistons, and a bottom expander axially moves upward relative to the lower expander body in response to axial movement of the one or more pistons. The one or more pistons preferably includes a first plurality of pistons for moving the top expander relative to the upper expander body, and a second plurality of pistons for moving the bottom expander relative to the lower expander body. Each of the upper expander body and lower expander body may include a set of slips for gripping engagement with the inner surface of the tubular string.

It a feature of the present invention that the lower expander in one embodiment includes a first plurality of axially-spaced expander segments and a second plurality of axially-spaced expander segments. Each of the second plurality of expander segments is spaced between adjacent first expander segments and is axially movable relative to the first expander segments. When the first and second plurality of expander segments are vertically aligned, the expander segments together expand the lower expander body as they are moved upward through the lower expander body. When the first expander segments are axially spaced from the second expander segments, the expander segments of the running tool may be passed through the central patch body for purposes of installing the running tool on the tubular patch and for retrieving the running tool to the surface after setting of the tubular patch.

In another embodiment, lower expander system includes a lower expander setting sleeve for expanding the lower expander body, with the sleeve-shaped lower expander setting sleeve remaining downhole to provide radial support for the lower expander body once expanded. The upper expander system may similarly include an upper expander setting sleeve for expanding the upper expander body, such that the sleeve-shaped upper expander setting sleeve also remains downhole to provide radial support for the upper expander body once expanded.

It is a feature of the present invention that an outer sleeve interconnects a first plurality of cylinders to the top expander, and that a shear member may be provided for interconnecting the outer sleeve and the running string.

A related feature of the invention is that another shear member may be provided for disconnecting the first plurality of pistons and the top expander after a selected axial movement of the top expander relative to the upper expander body.

It is a feature of the invention that exterior seals may each be formed from a variety of materials, including a graphite material.

It is another feature of the invention that an expansion joint may be provided between the upper expander body and the lower expander body for thermal expansion and/or contraction of the central patch body.

Still another feature of the invention is that the running tool may be provided with a plug seat, so that a plug landed on the seat achieves an increase in fluid pressure within the running tool and to the actuating pistons.

Another significant feature of the present invention is that a running tool and method are provided for expanding a downhole tubular while within the well. Hydraulic pressure may be applied to the tool to act on the lower expander to either expand an outer tubular, or to expand the lower expander body of the thermal patch.

In one embodiment, the expander members may be positioned between axially aligned positions for expanding the downhole tubular and axially separated positions for allowing the expander members to collapse allowing the running tool to be easily retrieved to the surface.

In another embodiment, the expanded lower expander body is radially outward of a lower expander setting sleeve, which is moved from a run-in position to the set position by the second plurality of pistons. The expanded upper expander body is similarly radially outward of an upper expander setting sleeve, which is moved downward from a run-in position to a set position by the first plurality of pistons. Each expander setting sleeve remains downhole to provide radial support to the upper and lower expander body once expanded.

Yet another feature of the invention is that a plurality of dogs or stops may be provided on the running tool for preventing axial movement of the upper expander body in response to downward movement of the upper expander, and axial movement of the lower expander body in response to upward movement of the lower expander. The dogs may move radially inward to a disengaged position for purposes of installing the running tool on the tubular patch and for retrieving the running tool after installation of the tubular patch. Each of a plurality of dogs may be biased radially outward to an engaged position within the controlled gap of the expansion joint.

It is a significant advantage that the system for forming a patch in a well according to the present invention utilizes conventional components with a high reliability. Also, existing personnel with a minimum of training may reliably use the system according to the present invention, since the invention relies upon utilizing well-known surface operations to form the downhole patch.

These and further objects, features and advantages of the present invention will become apparent from the following detailed description, wherein reference is made to the figures in the accompanying drawings.

DETAILED DESCRIPTION OF PREFERRED EMBODIMENTS

FIGS. 1A–1J disclose a preferred system for forming a patch in a well at a location along a downhole tubular string that has lost sealing integrity. The running tool is thus suspended in a well from the work string WS, and positioned within the casing C. The system of the present invention positions a tubular patch within the downhole casing C at a location that has lost sealing integrity, with the tubular patch being supported on the running tool 10 and thus suspended in the well from the work string WS.

Figure 1A:
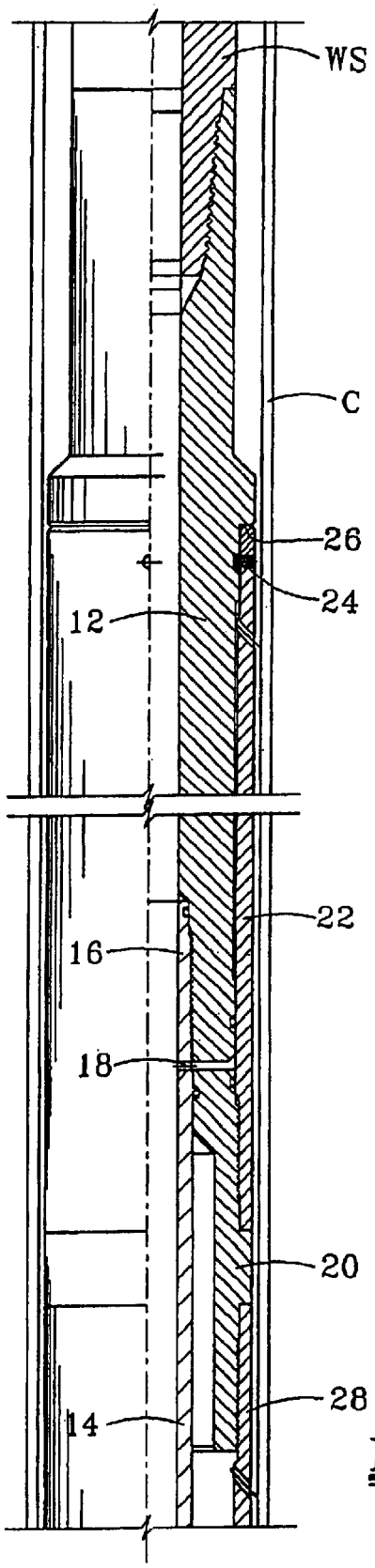
FIGS. 1A through 1J illustrate sequentially (lower) components of the patch system according to the present invention. Those skilled in the art will appreciate that line breaks along the vertical length of the tool may eliminate well known structural components for interconnecting members, and accordingly the actual length of structural components is not represented. The system as shown in FIG. 1 positions show the running tool on a work string, with the running tool supporting a tubular patch in its run-in configuration.
Figure 1B:
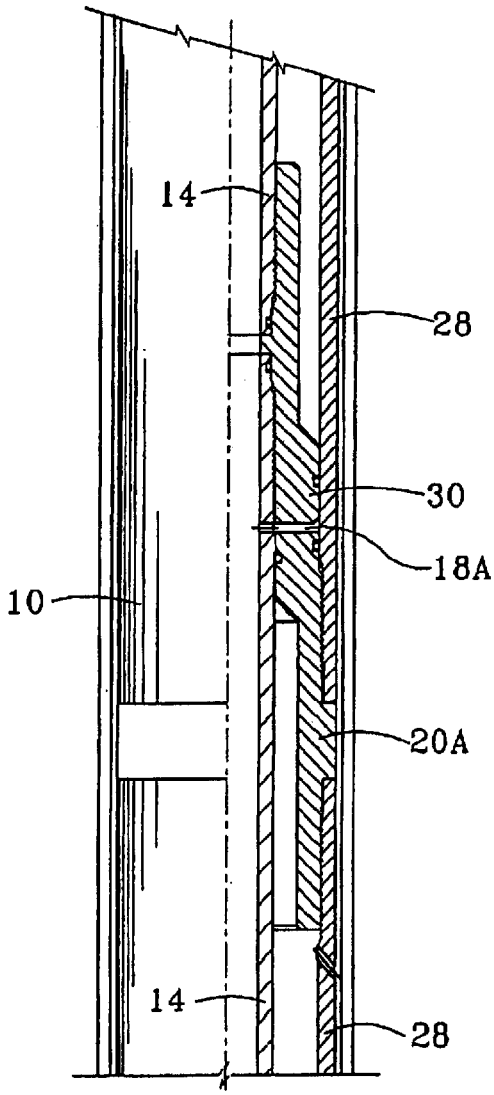
Figure 1C:
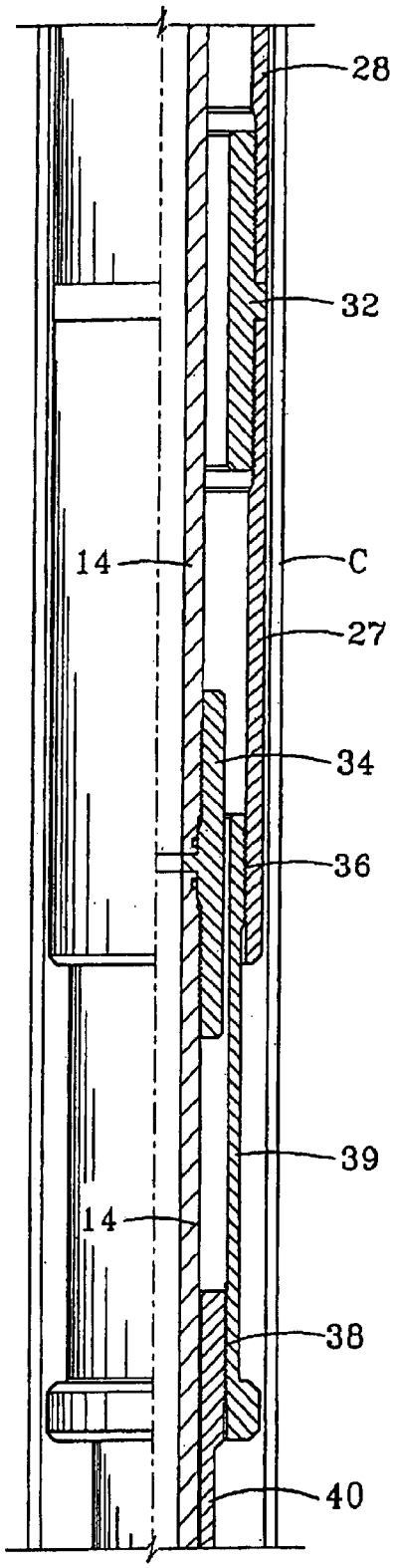
Figure 1D:
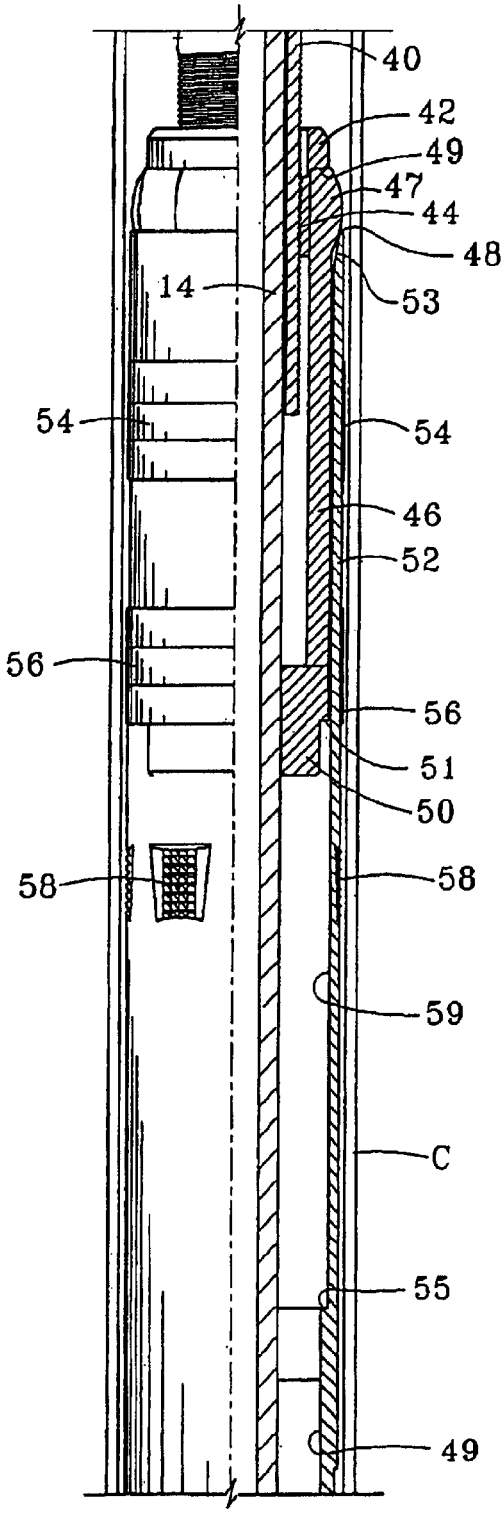
Figure 1E:
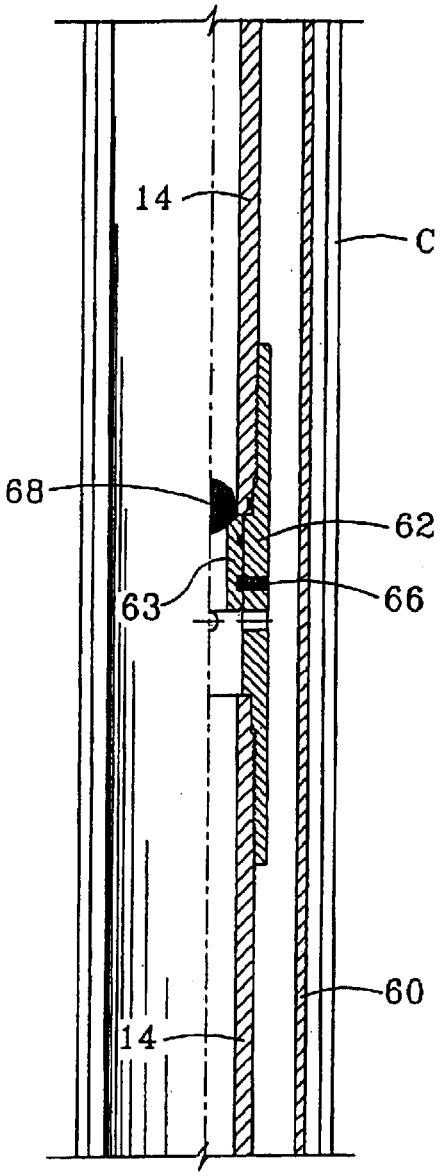
Figure 1F:
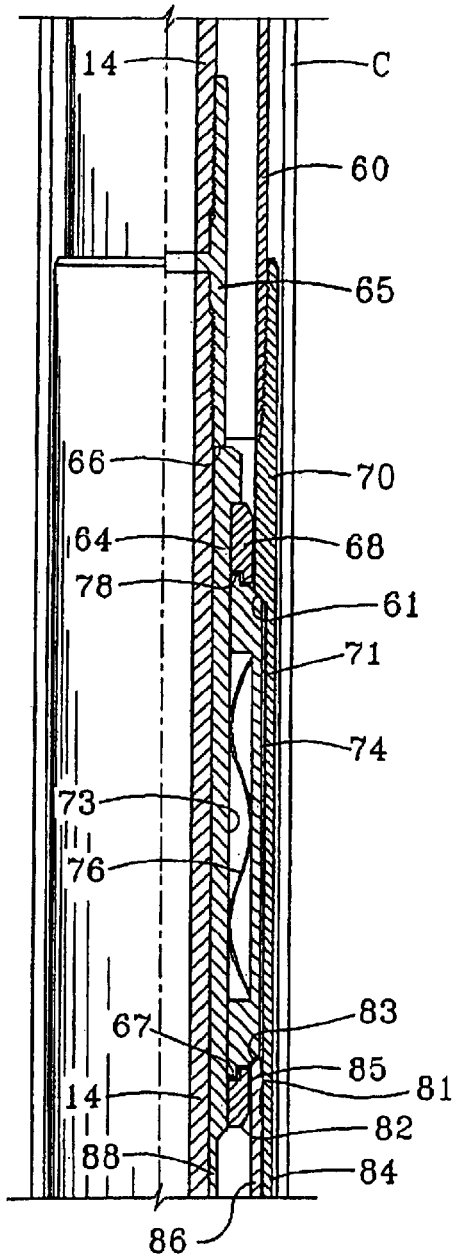
Figure 1G:
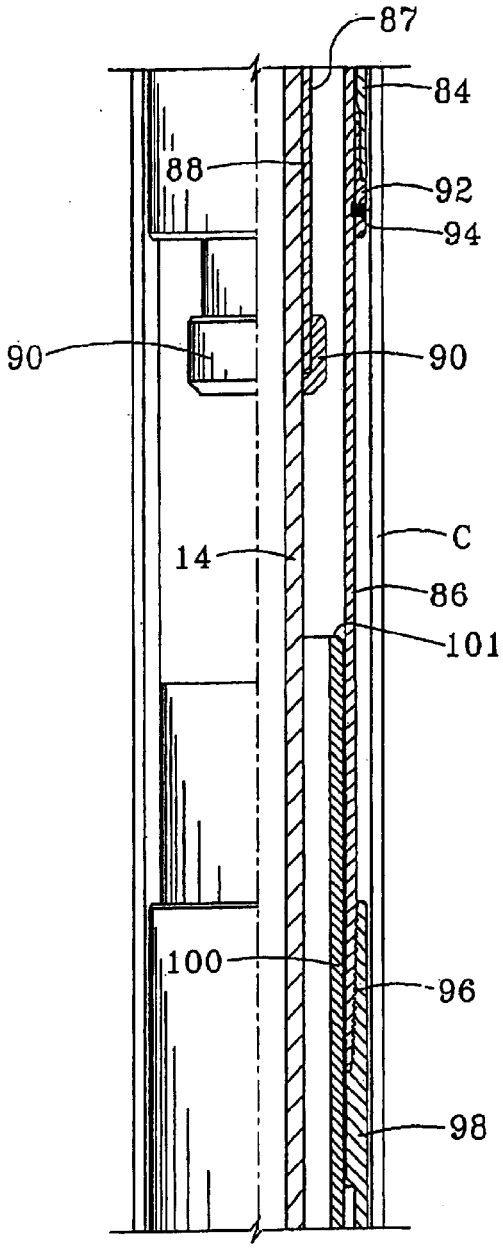
Figure 1H:
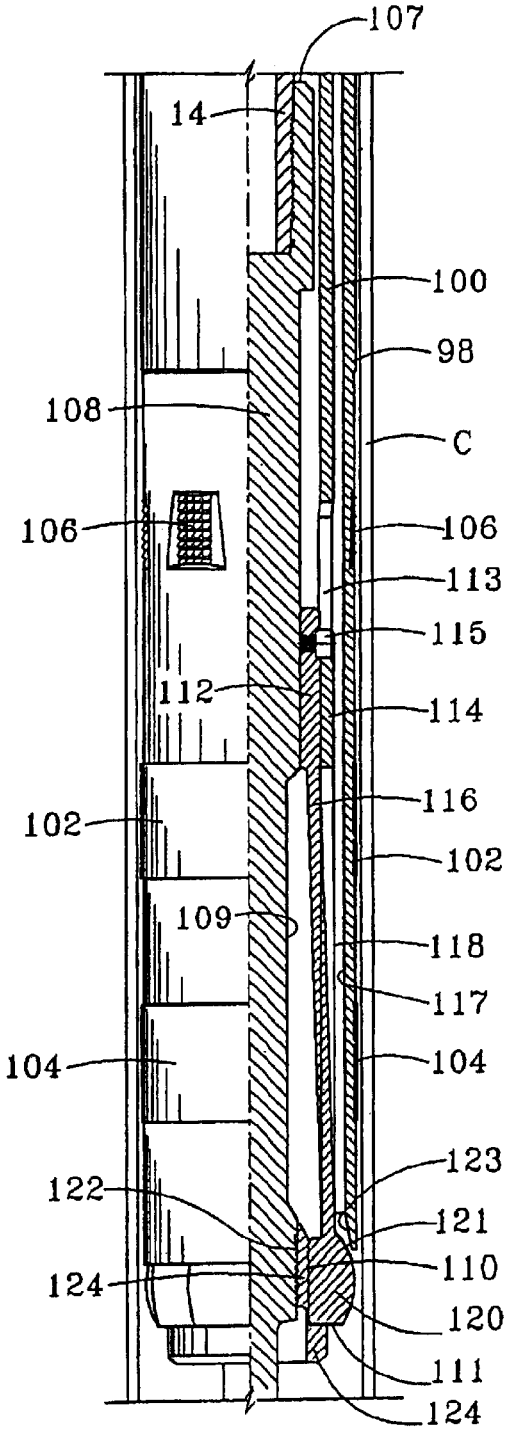
Figure 1I:
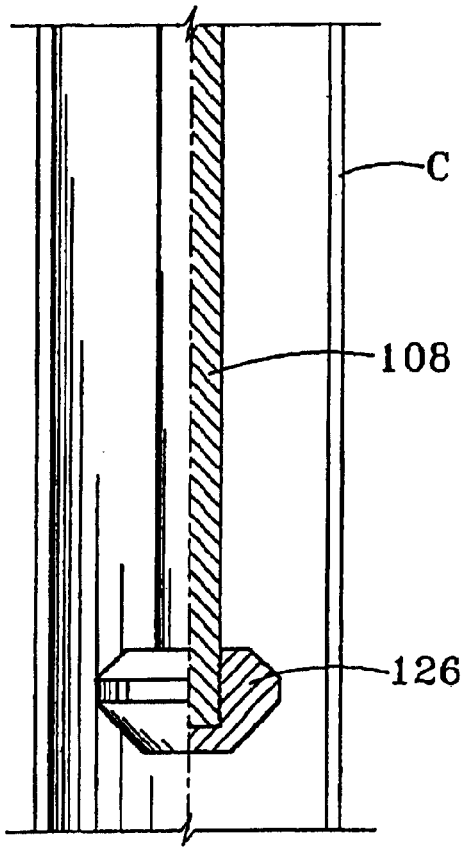

FIGS. 1D–1H depict the tubular patch of the present invention along with various components of the running tool. When installing the patch within a well, the patch is assembled from its lowermost component, the lower expander body 98, to its uppermost component, the upper expander body 52, and lowered into the well and suspended at the surface. The lower expander body 98 is attached by thread connection 96 at its upper end to the expansion joint mandrel 86, as shown in FIGS. 1G and 1H. The expansion joint mandrel extends into a honed seal bore of the expansion joint body 70 and maintains sealing engagement therewith by a dynamic metal-to-metal ball seal 81 on expansion joint mandrel 86. A sealed expansion joint thus allows thermal expansion and contraction of the thermal patch secured at the upper and lower ends to the casing. A controlled gap 71 of a selected axial length, located between the shoulder 61 and the top end 83 of the expansion joint mandrel 86, is maintained by shear pins 94 (FIG. 1B) extending from the retainer 92, which is threadedly attached to the bottom 84 of the of the expansion joint body 70. FIGS. 1E and 1F depict a portion of the central patch body 60 of the tubular patch. The central patch body 60 extends upward from the expansion joint body 70 to the upper expander body 52, as shown in FIG. 1D. The central patch body 60, in many applications, may have a length of from several hundred feet to a thousand feet or more. Both the lower expander body 98 and the upper expander body 52 preferably have a generally cylindrical interior surface and support one or more vertically spaced respective external seals 102,104 and 54, 56 formed from a suitable seal material, including graphite. Graphite base packing forms a reliable seal with the casing C when the expander bodies are subsequently expanded into sealing engagement with the casing. Various types of elastomeric seals may alternatively be used. Both the lower expander body 98 and upper expander body 52 also preferably include a plurality of respectively circumferential-spaced slips 106, 58. The foregoing assembled tubular patch is thus suspended at the surface of the well, prepared for installation of the running tool.

Figure 1J:
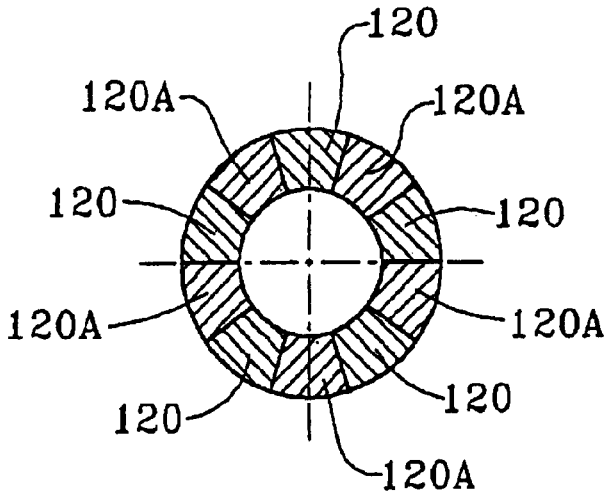

The running tool 10 is assembled in two halves to facilitate installation and support of the tubular patch thereon. The lower half of the running tool is illustrated in FIGS. 2B–2E and FIGS. 1C–1J, while the upper half of the running tool is illustrated in FIGS. 1A–1C and FIG. 2A. In FIGS. 2C and 2D, the I.D. of the central patch body 60 is shown by line 61.

Referring to FIGS. 1G and 1H, the lower body 108 of the running tool 10 is attached to the lower end of the running tool mandrel 14. An inner collet ring 112 is slidably supported about the lower body 108. A plurality of collet fingers 116 extends downward from the collet ring 112. An outer collet ring 114 is slidably supported about the inner collet ring 112, and a plurality of collet fingers 118 extend downward from collet ring 112. The outer collet ring is connected to the inner collet ring by limit screw 115 that is slidable within slot 113 in the outer collet ring. When in the position shown in FIG. 1H, the expanded position, each of the collet fingers includes a lower end 120 with a radially expanding outer curved surface 121. Shear collar 124 is threaded at 122 to body 108 and engages the lower collar support surface 111 to fix the downward position of the lower ends 120 when expanding the lower expander body 98. The inner surface 110 on each of the lower ends 120 thus engages the upper surface of shear collar 124 to prevent the collet fingers 116 and 118 from flexing inward radially during the expanding operations. The expanders are circumferentially interlaced, as shown in FIG. 1J, during the expansion of the lower expansion body. The outer collet ring 114 has an upper extension 100 that serves to release the collets, and will be discussed in detail below.

The running tool mandrel 14 extends upward and is threadedly connected with the connector 65 having a stop surface 66 for engagement with sleeve 64. Sleeve 64 includes an upper portion having an enlarged diameter 73, and a lower portion 88 having a reduced diameter 87, as shown in FIGS. 1F–1G. A collar 90 is positioned at the lower end of the sleeve 88, with both sleeve 64 and collar 90 being in sliding engagement with mandrel 14. A cage 68 is supported in sliding engagement about the sleeve 64 and contains a plurality of windows 69 (see FIG. 2C) with retaining lugs 67 spaced radially about cage 68. A plurality of dogs 74 each extend through a respective window 69. The dogs 74 are furnished with upper lugs 78 and lower lugs 67 that limit radial movement of each dog within the windows. The dogs 74 prevent closing of the control gap 71 in the expansion joint 70 to prevent downward movement of the upper expander body in response to the top expander and upward movement of the lower expander body in response to the lower expander. A biasing member, such as spring 76, exerts a radially outward bias force on the dog 74. When the cage 68 and dogs 74 assembly are position about the enlarged diameter 73 of sleeve 64, the dogs are locked in an outward radial position. When the cage 68 and dogs 74 assembly are position about the reduced diameter 87 of sleeve 64, the dogs are released and can be moved radially inward within the respective window when an inward compressive force is applied to the dogs.

The lower half of the running tool, as thus assembled as discussed above, is run inside the tubular patch that is suspended within and from the surface of the well. Additional lengths of mandrel 14 and connectors 65 are threadedly made-up to the connector shown in FIG. 1F to correspond with the length of central patch body 60 of the tubular patch. As the lower half of the running tool is lowered into the tubular patch, the lower ends 120 of inner collet fingers 116 and outer collet fingers 118 are moved upward relative to the lower body 108 so as to position the lower ends 120 adjacent the reduced diameter 109 of lower body 108. Additionally, the inner collet ring 112 is moved upward relative to the outer collet ring 114, until limit pin 115 contacts the upper end of slot 113, as shown in FIG. 2D. This permits the upper and lower collet fingers to flex radially inward to the reduced diameter 109 of lower body 108 and allows the lower ends 120 to pass through the reduced internal diameter of the central patch body 60. Similarly, referring to FIG. 2C, the cage 68 is positioned adjacent the reduced diameter 87 of sleeve 64, allowing dogs 74 to be pressed inwardly, until the cage 68 has been lowered to a position adjacent the reduced internal diameter 49 of the upper expander body 52 (see FIGS. 1D–1F) by engagement of stop surface 66 on collar 65 with the top of sleeve 64. The cage 68 and dogs 74 may maintain this position adjacent the reduced diameter 87 of sleeve 64 until sufficient lengths of mandrel 14 have been added to position the cage and dogs adjacent the controlled gap 71 of the expansion joint of the tubular patch, at which time the enlarged diameter 73 of the sleeve 64 will move adjacent the cage 68 and dogs 74, thereby locking the dogs into the controlled gap 71.

After adding a sufficient length of mandrel 14 to the lower half of the running tool to correspond to the central patch body 60, a seat collar 63 (see FIG. 3A) is connected to the top of the mandrel 14, and supports a sleeve 64 that has a seat thereon and is connected to the seat collar 62 by pins 66. During expansion of the patch, a ball 68 or other type of plug lands on the sleeve seat 64 to close and seal the throughbore permitting increase in pressure within the running tool and develop the required forces to expand the tubular patch. Alternatively, the ball could land on a permanent seat, or the seat collar 62 could be furnished with a solid plug to use in place of a ball and seat.

A final length of mandrel 14 is added to the lower half of the running tool above the seat collar 62. An upper collet ring 50 is positioned in sliding engagement about the mandrel 14. A plurality of collet fingers 46 extend upward from the upper collet ring 50 and terminate in expander members 47 with curved surfaces 48 at their upper ends, as shown in FIG. 1D. The upper collet ring, collet fingers and expander members are lowered to engage the tapered surface 53 at the top of the upper expander body 52. An upper shear collar 42 is threadedly engaged with adjusting mandrel 40 and is placed about the mandrel 14 and lowered into engagement with the top 49 of expander members 47 of the expander collet 46. A connector 34 is attached to the top of the mandrel 14. The collet support hub 44 of the upper shear collar 42 supports the top expander members 47, thus preventing inward radial movement of the top expander members during setting of the tubular patch. Referring to FIG. 2E, the lower threads of sleeve 27 are threaded over the upper thread of adjusting collar 39 until the sleeve 27 and adjusting collar 39 are completely telescoped within one another. Similarly, the lower threads of adjusting collar 39 are threaded over the upper threads of the adjusting mandrel 40 until the bottom end 41 of adjusting collar 39 abuts the top of the shear collar 42.

After checking to ensure that the lower half of the running tool has been lowered sufficiently within the surface suspended tubular patch to position the lower ends 120 of the lower expanders below the bottom of lower expander body 98, the lower half of the running tool is raised, moving the inner surface 110 and the bottom surface 111 of the shear collar into engagement with the lower expanders 120. The expanders 120 are thereafter raised until the outer curved surface 121 of the expanders 120 engage the tapered bottom 123 at the bottom of the lower expander body 98, as shown in FIG. 1H.

With sufficient tensile strain maintained on the lower half of the running tool, the upper half of the running tool may now be attached to the lower half of the running tool and adjustments made for running the tubular patch to the desired setting depth within the well. The upper half of the running tool may be assembled as a unit from the top, as shown in FIGS. 1A–1C and FIG. 2A.

The upper end of the upper half of the running tool includes a conventional top connector 12 that is structurally connected by thread 16 to the running tool inner mandrel 14. A throughport 18 in the mandrel 14 and below the top connector 12 allows fluid pressure within the interior of the running tool to act on the outer connector 20, which as shown includes conventional seals for sealing between the mandrel 14 and the outer sleeve 28. A shear sleeve 22 may interconnect the outer connector 20 to the connector 12, so that downward forces in the work string WS may be transmitted to the outer sleeve 28 by shoulder 26 acting through the shear sleeve 22. A predetermined amount of fluid pressure within the running tool acting on the outer connector 20 will thus shear the pin 24 and allow for downward movement of the outer sleeve 28 relative to the connector body 12.

FIG. 1B shows another outer connector 20A and an inner connector 30. Fluid pressure to the inner connector 30 passes through the throughport 18A, and connector 30 is axially secured to the inner mandrel 14. Fluid pressure thus exerts an upward force on the inner connector 30 and thus the mandrel 14, and also exerts a further downward force on the outer sleeve 28A due to the outer connector 20A. Those skilled in the art will appreciate that a series of outer connectors, inner connectors, sleeves and mandrels may be provided, so that forces effectively "stack" to create the desired expansion forces, as explained subsequently. It is a particular feature of the present invention that a series of inner and outer connectors, outer sleeves and mandrels exert a force on each the upper expander body and lower expander body in excess of 100,000 pounds of axial force, and preferably in excess of about 150,000 pounds of axial force, to expand the expander bodies and effect release of the running tool from the tubular patch.

FIG. 1B shows a conventional connector 20A for structurally interconnecting lengths of outer sleeve 28, while connector 30 similarly connects lengths of mandrel. The lower end of sleeve 28A is connected to connector 32 to complete the upper half of the running tool 10, as shown in FIG. 2A.

Figure 2A:
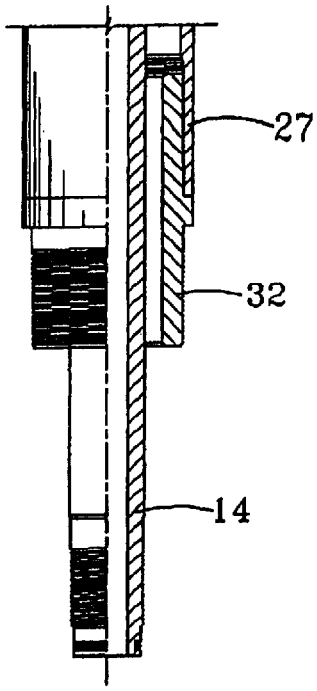
FIGS. 2A–2E illustrates components of the running tool partially within the central patch body during its installation an the tubular patch at the surface.
Figure 2E:
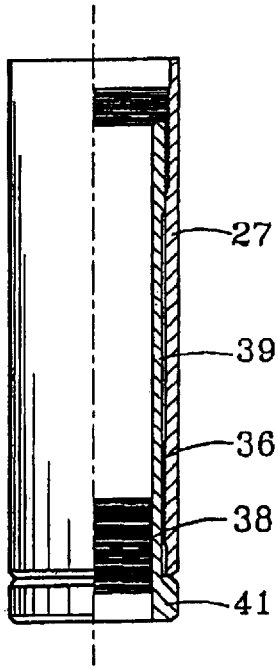
Figure 2B:
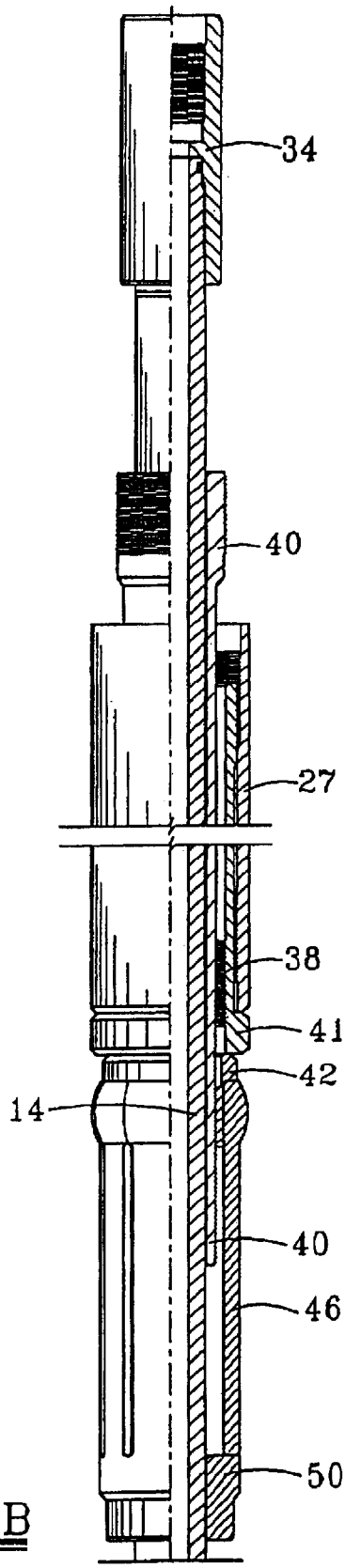
Figure 2C:
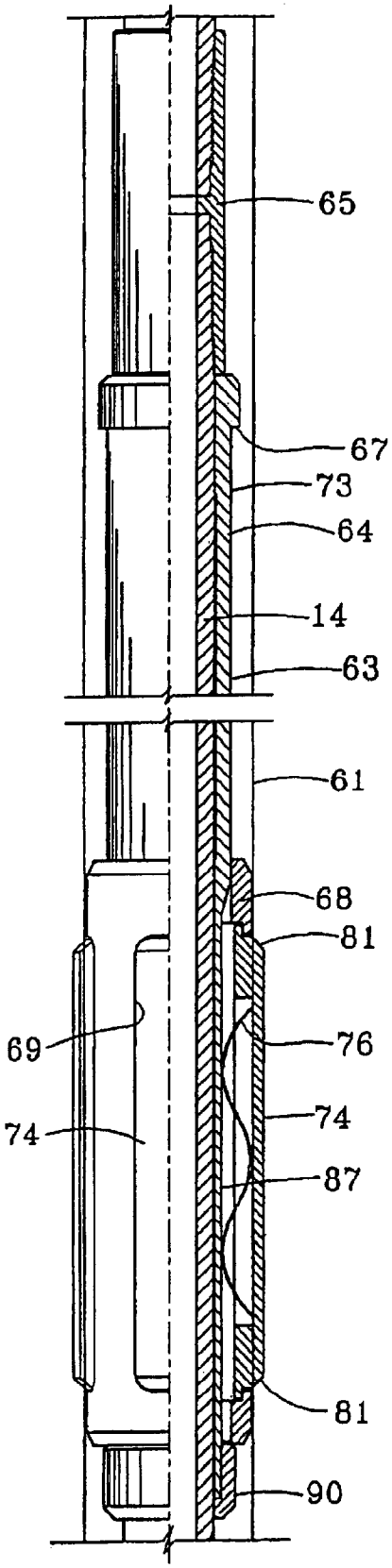
Figure 2D:
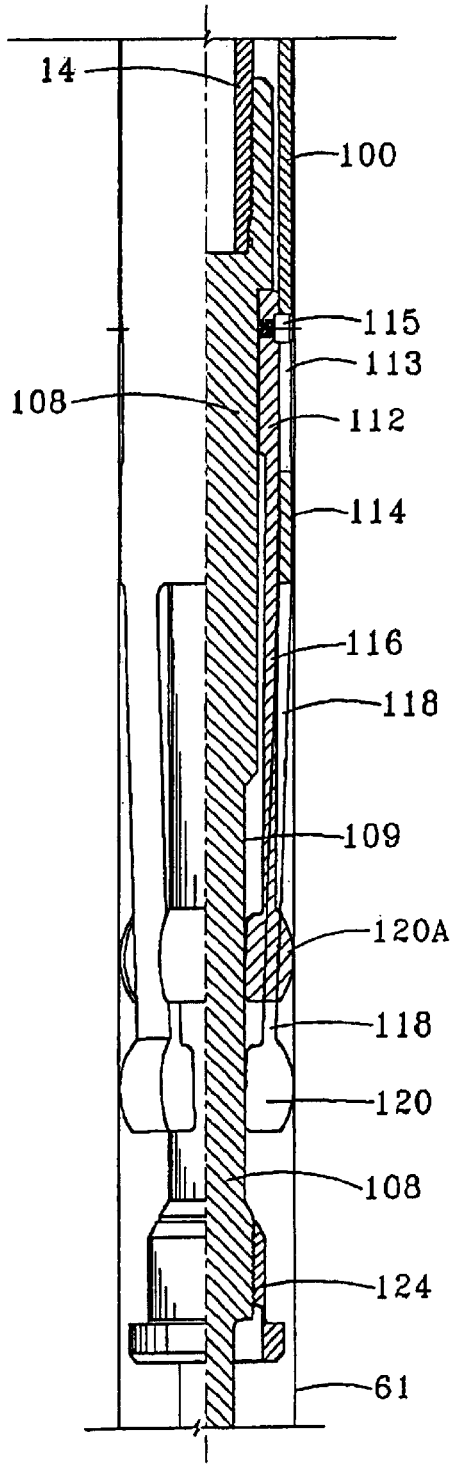

The upper half of the running tool 10 as above described may be connected to the lower half of the running tool (including the suspended tubular patch) by engagement of threads shown at the bottom of mandrel 14, as shown in FIG. 2A, with threads in the top of connector 34, as shown in FIG. 2B. With the running tool in tension while supporting the tubular patch on the expanders 120, the telescoped sleeve 27 and adjusting collar 39 are positioned to engage the thread 38 on the bottom of the adjusting collar 39 with the thread on the top of adjusting mandrel 40. The adjusting collar 39 and sleeve 27 are un-telescoped and the thread 36 on the bottom of the sleeve 27 is engaged with the external thread at the top of the adjusting collar 39, and the thread on the top of the sleeve 27 is engaged with the thread at the bottom of the connector 32, as shown in FIG. 1C. The upper shear collar 42 is adjusted downward on the lower threaded end 44 of the adjusting mandrel 40 until the expander members 47 with curved surfaces 48 abut the top internal tapered surface 53 of the upper expander body 52. With the tubular patch now properly supported on the running tool, a work string WS is connected to the top connector 12 and the tubular patch and running tool are conveyed to the setting depth within the well.

The tubular patch is set by seating a ball 68 or other plug on the sleeve seat 63 of the seat collar 62 and increasing fluid pressure to activate the plurality of pistons 20, 30 of the running tool to develop the required tensile and compressive forces to expand the tubular patch. Compressive forces are delivered to the upper expander members 47 to expand the upper expander body 52 of the tubular patch by shear sleeve 22, outer connectors 20 and 20A, sleeves 28, connector 32, sleeve 27, adjusting collar 39, adjusting mandrel 40 and upper shear collar 42 to axially move expander members 47 downward into the enlarged bore 59 of the upper expander body 52, thus expanding the exterior surface of the upper expander body 52 and bringing packing 54, 56 and slips 58 into respective sealing and gripping engagement with the casing C.

Simultaneously, tensile forces are delivered to the lower expander members 120 to expand the lower expander body 98 of the tubular patch by top connection 12, mandrels 14, inner connectors 30, connector 34, seat collar 62, connector 65, lower body 108 and lower shear collar 124 to axially move expander members 120 into the enlarged bore 117 of the lower expander body 98, thus expanding the exterior surface of the lower expander body 98, and bringing packing 102, 104 and slips 106 into respective sealing and gripping engagement with the casing C. Tensile and compressive forces developed by the running tool in expanding the tubular patch are prevented from closing the axial controlled gap 71 of the expansion joint by locking the dogs 74 within the controlled gap 71 as previously discussed.

Figure 3A:
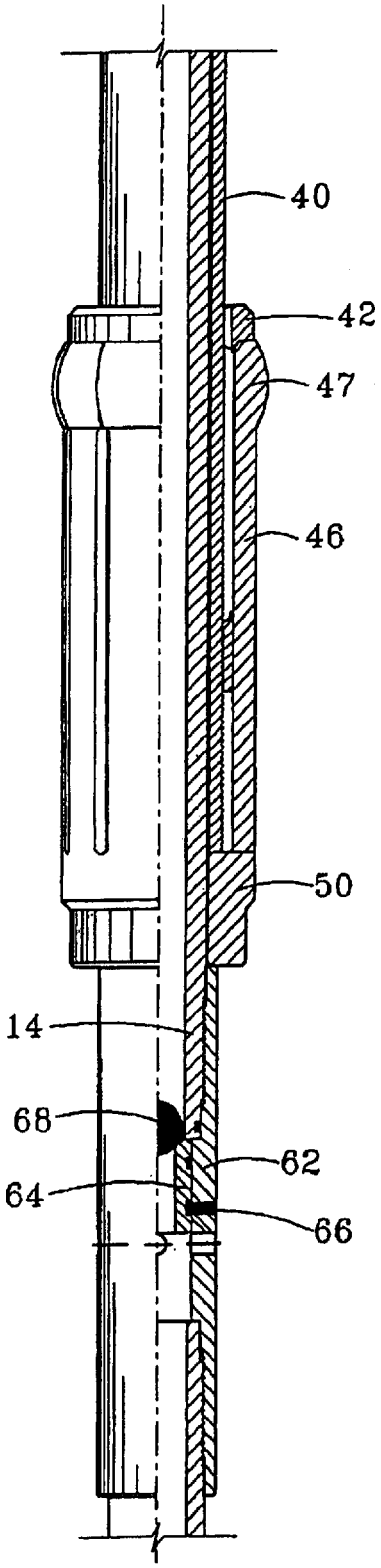
FIG. 3A illustrates components of the running tool with the ball landed to increase fluid pressure to expand the upper expansion body and to shear the upper shear collar.

As the running tool continues to "stroke" under fluid pressure and the upper expander body 52 and lower expander body 98 are expanded against the casing, sufficient forces are developed by the running tool to effect shearing of the lower shear collar 124, and optionally also the upper shear collar 42, to release the running tool 10 from the expanded tubular patch. The upper expander members 47, collet fingers 46 and collet ring 50 are forced downward inside the upper expander body until shoulder 51 of collet ring 50 abuts internal shoulder 55 of upper expander body 52, stopping further downward axial movement of the expander members 47. Increased fluid pressure continues to move compressive members of the running tool downward, shearing the controlled thin walled section of the upper shear collar 42, allowing the threaded hub of the shear collar to move toward the collet ring 50, thereby permitting the expander members 47 and the upper collet fingers 46 to flex inward, as permitted by the axial gaps between the collet fingers 46. As the work string WS is raised to pull the running tool from engagement with the tubular patch, the upper shoulder of seat collar 62 abuts the collet ring 50, as shown in FIG. 3A, lifting the upper collet and expander from engagement with the upper expander body 52.

Figure 4A:
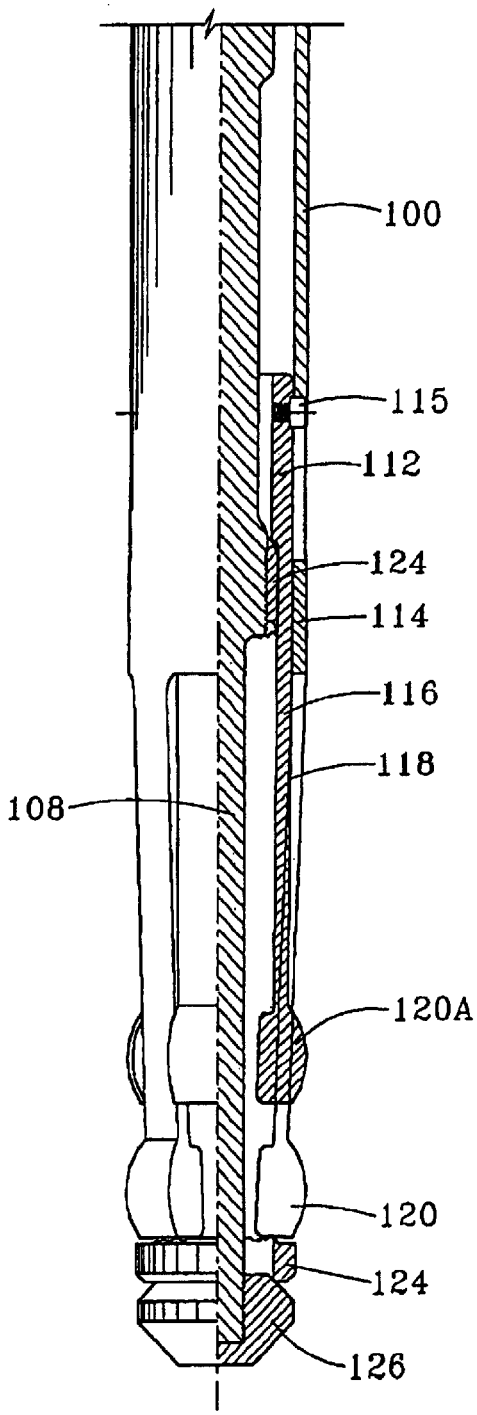
FIG. 4A shows the lower end of the running tool configured for withdrawing the running tool from the tubular patch to the surface.

Simultaneously, the lower expander members 120, outer collet fingers 118, inner collet fingers 116, inner collet ring 112 and outer collet ring 114 and its upper extension 100 are forced upward inside the lower expander body 98 until the top shoulder 101 of upper extension 100 abuts the bottom shoulder 82 (FIG. 1F) of the cage 68 that is retained in its locked position by virtue of the dogs 74 positioned in the axial controlled gap 71 of the expansion joint 70. Increased pressure continues to move tensile members of the running tool upward, shearing the controlled thin walled section of the lower shear collar 124, allowing the threaded hub of the shear collar to move into abutment with the inner collet ring 112, thereby shifting upward the inner collet ring 112, the inner collet fingers 116 and the attached expander members 120A, until limit pin 115 abuts the upper end of slot 113 in the outer collet ring 114. This upward shifting of the inner expander members 120A and the inner collet FIGS. 116 move the inner expander members 120A axially from outer expander members 120 on the outer collet fingers 118. Both expander members 120 and 120A can now flex inwardly toward the reduced diameter 119 of lower body 108, as shown in FIG. 4A. The lower sheared portion of shear collar 124 is caught by lower retainer 126, as shown in FIG. 4A. As the running tool 10 is raised upward by the workstring WS relative to the tubular patch, the top shoulder 107 of lower body 108 engages the bottom of collar 90 attached to sleeve 64. Continued raising of the workstring moves the enlarged diameter 73 of sleeve 64 from locking engagement with the dogs 74 and positions the reduced diameter portion 87 of sleeve 64 adjacent the dogs 74. The cage 68 and dogs 74 are thus released from the controlled gap 71 within the tubular patch as the running tool is released from the tubular patch and pulled from the well.

Figure 5A:
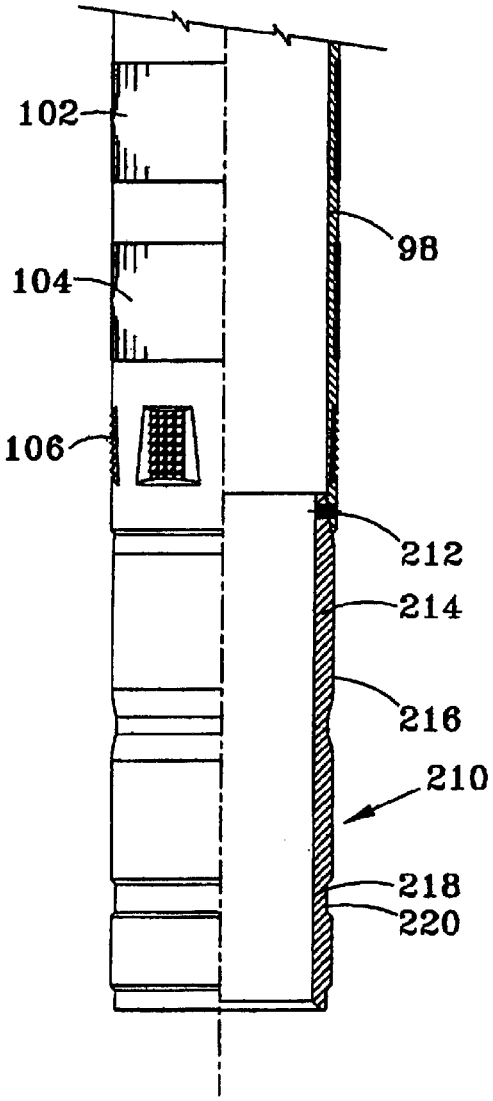
FIG. 5A illustrates an alternate embodiment of a lower portion of the patch system including a lower expander setting sleeve.

FIG. 5A shows an alternate embodiment of the invention which uses a lower expander setting sleeve 210 axially secured by shear member 212 to lower expander body 98, which includes packing 102, 104, and slips 106. The expander setting sleeve 210 preferably is a continuous sleeve-shaped member which radially supports the lower expander body 98 once expanded. The expander setting sleeve may include a plurality of radially thick body portions 214 each having a radially outward projecting exterior surface 216, and a plurality of radially thin body portions 218 each axially spaced between two thick portions 214, with the recessed exterior surfaces 220 being spaced radially inward from the projecting exterior surfaces 216. By providing the portions 218 with recessed exterior surfaces 220, the forces required to move the expander setting sleeve to the set position are reduced compared to an embodiment wherein the exterior setting sleeve remains the diameter of the projecting exterior surfaces 216.

Figure 5B:
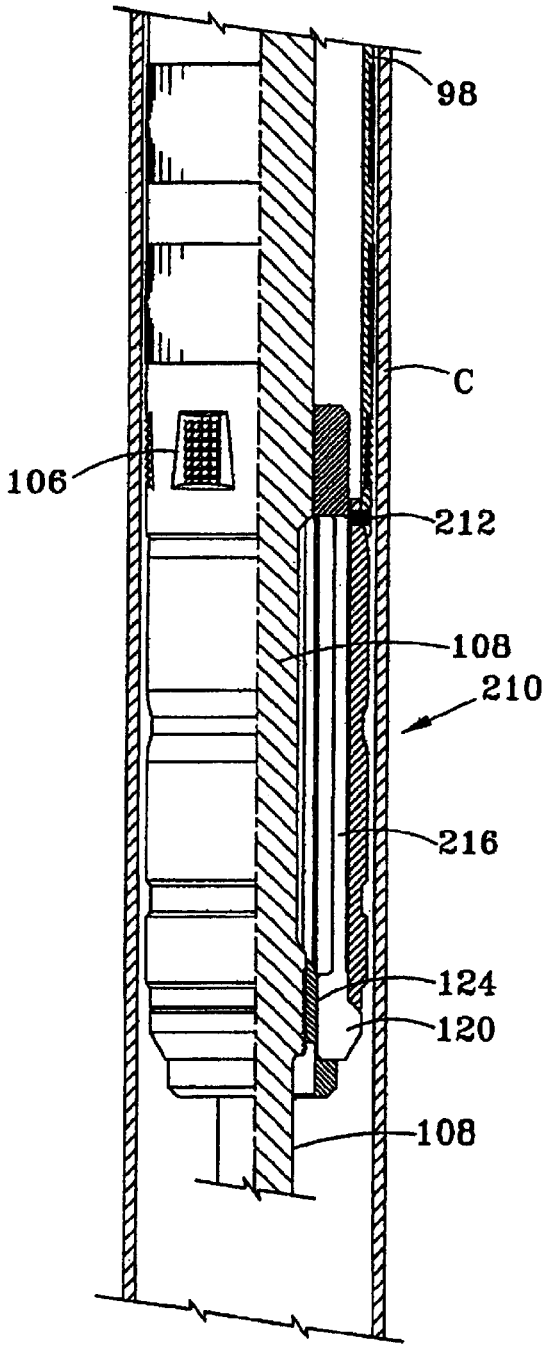
FIG. 5B shows the lower portion of the alternate embodiment running tool in the pre-expansion position.

FIG. 5B shows the running tool moved from the run-in portion to a pre-expansion position prior to expanding the lower expander body 98 into engagement with the casing C. The running tool may be substantially similar to the tool previously described, with the running tool having a lower body 108 and shear collar 124 as described above. Lower end 120 of the collet fingers 216 are moved upward with the expander setting sleeve 210 to expand the lower expander body. When the collet fingers 216 move up, the pin 212 is sheared, and setting sleeve 210 is moved axially upward, bring surfaces 216 of thick body portions 214 into engagement with the lower expander body 98, radially expanding the body 98 into engagement with the casing C, as shown in FIG. 5C.

The mechanism for setting the lower expander body in the FIG. 5B embodiment does not require the use of a pair of collets each with circumferentially arranged collet fingers, as disclosed in FIG. 1H. Since the lower expander body is now expanded by the lower setting sleeve 210, the collets 216 must simply be moved upward to shear the pin 212 and move the lower setting sleeve 210 from a position as shown in FIG. 5B to a position as shown in FIG. 5C. The operation for accomplishing this movement and thereby bringing the lower expander body into engagement with the casing may be accomplished with the drive mechanism discussed above. Once the lower setting sleeve 210 moves upward into engagement with the stop shoulder 264 as shown in FIG. 5C, the running tool including the collet fingers 216 may be retrieved through the casing C.

Figure 5C:
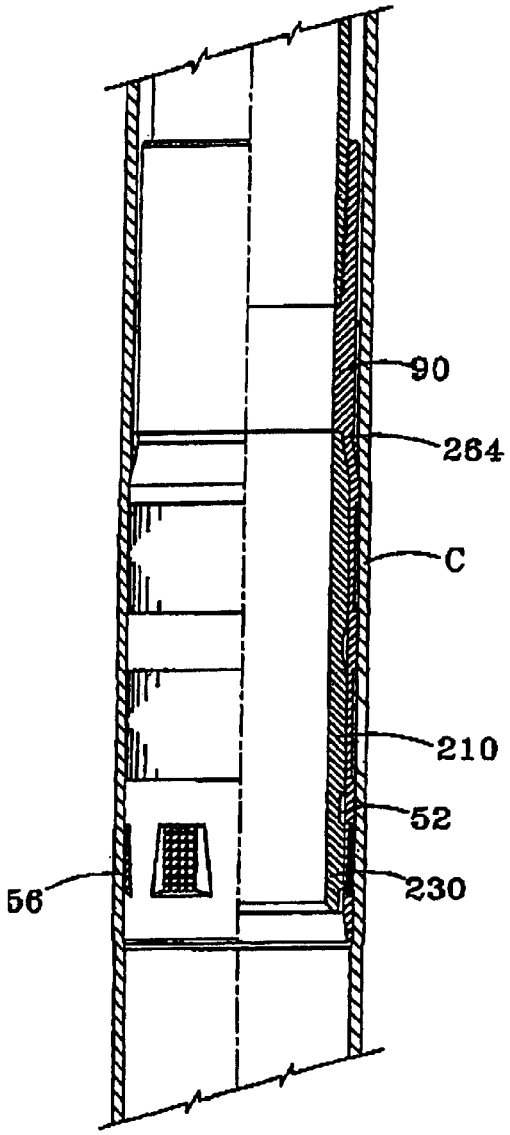
FIG. 5C shows the running tool retrieved and the lower expander setting sleeve radially inward of the lower expander body.

FIG. 5C shows the running tool retrieved and the expander setting sleeve 210 positioned radially inward of and axially aligned with the lower expander body 98, expanding the lower expander body outward into gripping engagement with the casing C. Expander setting sleeve 210 includes an end surface which engages the stop surface 264 on the lower expander body 98, as discussed above, once the lower expander setting sleeve is moved axially to the set position. The sleeve-shaped expander setting sleeve 210 thus provides substantial radial support to the lower expander body 98 once the running tool is returned to the surface. This increased radial support to the downhole tubular, such as the casing, provided by the sleeve shaped bottom expander 210 may be very significant, e.g., to providing fluid tight engagement between the wall of the lower expander body 98 and casing C.

Figure 5D:
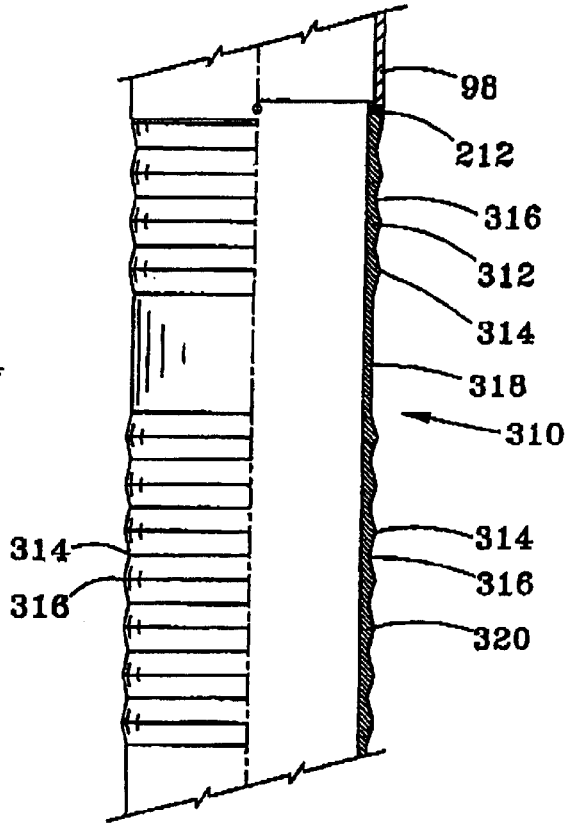
FIG. 5D illustrates an alternative expander setting sleeve.

FIG. 5D depicts an alternative design for an expander setting sleeve 310, which may be attached to the expander body 98 by shear pin 212, so that the FIG. 5D design is a replacement of the FIG. 5A design. In the FIG. 5D design, the expander setting sleeve has a portion 312 which includes a plurality of axially spaced annular "hills" 314 and annular valleys 316. The series of hills and valleys in portion 312 is separated by a thin wall portion 318 from portion 320, which again has a series of annular hills 314 and valleys 316. The design as shown in FIG. 5D provides less engaging surface with the interior surface of the lower expander body 98, and thereby further reduces the forces required to move the lower expander body to the set position. As shown in FIG. 5D, the axially spaced radially outward protrusions or hills 314 and the radially inward protrustions or valleys 316 may be formed in a spiral arrangement.

Figure 6A:
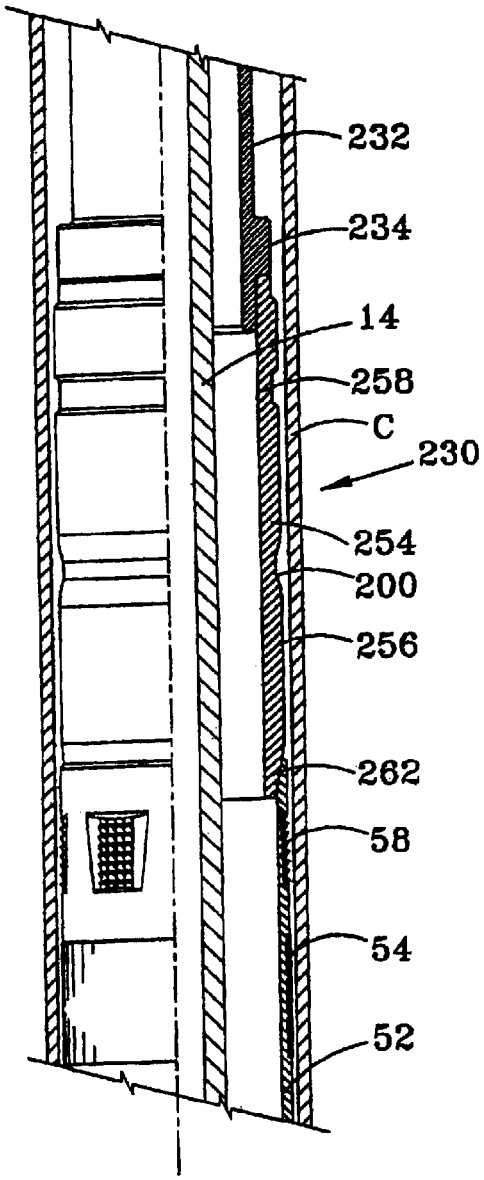
FIG. 6A illustrates an upper expander setting sleeve positioned axially above an upper expander body.
Figure 6B:
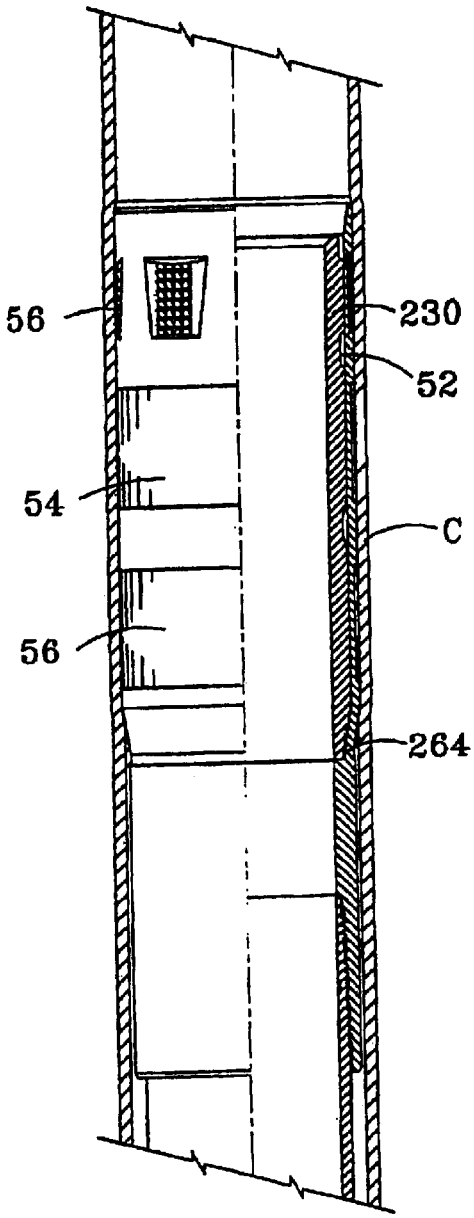
FIG. 6B illustrates the upper expander setting sleeve shown in FIG. 6A moved axially downward to a position radially inward of the upper expander body, thereby forcing the upper expander body radially outward into secured engagement with the casing.

FIGS. 6A and 6B illustrate that this alternate embodiment may also utilize an upper expander setting sleeve to provide radial support for an upper expander body once expanded. With reference to FIG. 6A, the running tool may be similar to the tool previously described, with a central mandrel 14 and upper expander body 52 supporting packing 54, 56 and slips 58. Mandrel 232 as shown on FIG. 6A is moved axially in response to actuation of a first plurality of pistons, and is forced downward during the setting operation. The expanded diameter lower portion 234 on the mandrel 232 thus engages the upper expander setting sleeve 230, as shown in FIG. 6A. Upper expander setting sleeve 230 includes radially thick body portions 254 having a radially outer surface 256, and radially thin body portions 258 having a recessed outer surface 260. The lower end 262 of the upper expander setting sleeve 230 may be tapered for engagement with the upper end of the upper expander body 52.

In response to actuation of the first plurality of pistons, mandrel 232 is forced downward relative to the upper expander body 52, thereby moving the upper expander setting sleeve 230 downward to a position as shown in FIG. 6B, wherein the upper expander setting sleeve 230 is radially inward of and axially aligned with the upper expander body 52, thereby forcing the body 52 radially outward into reliable engagement with the casing C. FIG. 6B shows the running tool retrieved, with the upper expander setting sleeve 230 providing significant radial support to the upper expander body 52 once expanded. The lower end of the upper expander setting sleeve 230 may include a shoulder surface which engages a stop surface 264 on the upper expander body 52 once the upper expander setting sleeve is moved axially to the set position. Significantly increased radial support to the casing or other downhole tubular is provided by the sleeve shape bottom expander and the upper expander to provide highly reliable fluid tight engagement between the walls of the expander bodies and the casing C, thereby fixedly connecting the tubular patch to the downhole tubular.

Those skilled in the art will appreciate that the patch of the present invention provides a highly reliable system for sealing within a casing, and is particularly designed for a system that minimizes the annular gap between the sealing element and the casing under elevated temperature and pressure conditions that are frequently encountered in downhole thermal hydrocarbon recovery applications. In some applications, an expansion joint along the length of the patch body may not be required, and thus the dog and cage assembly discussed above used to limit or prevent axial movement of the upper and lower expander bodies may be eliminated. While two upper seals and two lower seals are shown, at least one upper seal on the upper expander body and at least one lower seal on the lower expander body will be desired for most applications.

Those skilled in the art will appreciate that the running tool of the present invention may also be used in various applications for expanding the diameter of a downhole tubular. In one application, only a mid-portion of a downhole tubular may be expanded, e.g., to assist in closing off a water zone from hydrocarbon zones above and below the water zone. In that case, the downhole tubular may be expanded with a tool similar to that disclosed above. An expanded recess may be provided in which the expander members 120 may be positioned, and the downhole tubular expanded with hydraulic forces to pull the inner tool mandrel upward, as disclosed herein. In other applications, substantially the entire length of the outer tubular may be expanded by performing a series of expansion operations, each initiated by grippingly engaging the body of the tool with an upper portion of the outer tubular, using hydraulic forces as disclosed herein to pull an inner mandrel of the tool upward and expand the outer tubular to a position below the engaging slips, and then raising the engaging slips to a higher level in the well while leaving the lower expanders below the upper end of the expanded tubular. Those skilled in the art will appreciate the significant advantages of the tubular expander and method of the present invention in that, if for some reason the tool is not able to expand the outer tubular during the expansion operation, fluid pressure may be increased to allow the expansion members 120 and 120A to axially separate, thereby allowing the tool to be easily retrieved to the surface through the unexpanded portion of the outer tubular.

As disclosed herein, a preferred embodiment of the invention for forming a tubular patch includes a first plurality of pistons for raising the lower expander members 120, and another plurality of pistons for lowering the upper expander members 47. This configuration significantly improves the reliability of the tool, and allows the operator to effectively select the desired axial force for the expansion operation by stacking pistons, as discussed above. In a less preferred embodiment, one or more hydraulic pistons may be provided, and either hydraulic flow channels or mechanical linkage mechanisms used to convert the force from the one or more pistons to opposing upward and downward forces which will raise the lower expanders and lower the upper expanders, respectively.

Once the upper expander body and lower expander body have been radially expanded for gripping engagement with the casing as disclosed herein, the setting tool may be completely released from the well and returned to the surface. The same setting tool may be used in multiple applications, with the upper and lower expander bodies, and preferably also the upper and lower expander setting sleeves, remaining downhole.

It will be understood by those skilled in the art that the embodiments shown and described are exemplary and various other modifications may be made in the practice of the invention. Accordingly, the scope of the invention should be understood to include such modifications, which are within the spirit of the invention.

What is claimed is:

1. A system for forming a patch in a well at a location along a downhole tubular string which has lost sealing integrity, comprising:

a tubular patch for positioning within the downhole tubular string at the location which has lost sealing integrity, the tubular patch being supported on a running tool suspended in the well from a work string;

the tubular patch including a central patch body having a generally cylindrical central interior surface, an upper expander body having a generally cylindrical upper interior surface and at least one upper exterior seal, and at least one lower expander body having a generally cylindrical lower interior surface and a lower exterior seal;

the running tool including an inner mandrel axially moveable relative to the central patch body, one or more pistons each axially moveable relative to the inner mandrel in response to fluid pressure within the running tool, a top expander axially moveable downward relative to the upper expander body in response to axial movement of the one or more pistons for radially expanding the upper expander body into sealing engagement with the downhole tubular string, and a bottom expander axially moveable upward relative to the lower expander body in response to axial movement of the one or more pistons for radially expanding the lower expander body into sealing engagement with the downhole tubular string, and for radially collapsing to withdraw the running tool from the well after expanding the lower expander body; and wherein the bottom expander includes an expander setting sleeve axially moveable in response to the one or more pistons from a run-in position wherein the expander setting sleeve is axially spaced below the lower expander body to a set position wherein the expander setting sleeve is radially inward of and axially aligned with the lower expander body.

2. A system as defined in claim 1, wherein the one or more pistons includes a first plurality of pistons for moving the top expander relative to the upper expander body, and a second plurality of pistons move the lower expander relative to the lower expander body.

3. A system as defined in claim 1, wherein the upper expander body further includes an upper set of slips for gripping engagement with an inner surface of the tubular string, and the lower expander body includes a lower set of slips for gripping engagement with the tubular string.

4. A system as defined in claim 1, wherein the lower expander includes a first plurality of expander segments and a second plurality of expander segments, each of the second plurality of expander segments being spaced between adjacent first expander segments and axially moveable relative to the first expander segments, such that when the first and second plurality of expander segments are vertically aligned, the first and second expander segments together expand to the lower expander body, and when the first plurality of expander segments are axially spaced from the second plurality of expander segments, the running tool may be retrieved to the surface through the central patch body.

5. A system as defined in claim 2, further comprising: an outer sleeve interconnecting the first plurality of pistons and the top expander; and a shear member for interconnecting the outer sleeve and the work string.

6. A system as defined in claim 5, further comprising: an upper shear member for disconnecting the first plurality of pistons and the top expander after a selected axial movement of the top expander relative to the upper expander body.

7. A system as defined in claim 1, wherein each of the upper exterior seal and the lower exterior seal include axially spaced seal bodies formed from a graphite based material.

8. A system as defined in claim 1, further comprising: a sealed expansion joint between the upper expander body and the lower expander body for thermal expansion of the central patch body.

9. A system as defined in claim 8, further comprising:

a plurality of circumferentially spaced dogs each radially engaged to prevent downward movement of the upper expander body in response to the top expander and upward movement of the lower expander body in response to the bottom expander, and radially disengaged for retrieval from the upper expander body in response to axial movement of the inner mandrel.

10. A system as defined in claim 9, further comprising:

a plurality of biasing members for biasing each of the plurality of dogs radially outward.

11. A system as defined in claim 1, wherein the expander setting sleeve remains downhole and radially supports the lower expander body when the running tool is returned to the surface.

12. A system as defined in claim 1, wherein the expander setting sleeve engages a stop shoulder on the lower expander body when moving to the set position.

13. A system as defined in claim 1, wherein the expander setting sleeve includes a plurality of axially spaced radial projecting exterior surfaces between axially spaced recessed exterior surfaces to reduce frictional forces during expanding of the lower expander body to the set position.

14. A system as defined in claim 1, wherein the top expander moves an upper expander setting sleeve axially downward in response to the one or more pistons from a run-in position wherein the expander setting sleeve is axially spaced above the upper expander body to a set position wherein the upper expander setting sleeve is radially inward of and axially aligned with the upper expander body.

15. A system as defined in claim 14, wherein the upper expander setting sleeve remains downhole and radially supports the upper expander body when the running tool is returned to the surface.

16. A system as defined in claim 14, wherein the upper expander setting sleeve includes a plurality of axially spaced radially projecting exterior surfaces between axially spaced recessed exterior surfaces to reduce frictional forces during expansion of the upper expander.

17. A method of forming a patch in a well at a location along a downhole tubular string which has lost sealing integrity, comprising:

positioning a tubular patch within the downhole tubular string at the location which has lost sealing integrity, the tubular patch being supported on a running tool suspended in the well from a work string;

providing the tubular patch with a central patch body having a generally cylindrical central interior surface, an upper expander body having a generally cylindrical upper interior surface and at least one upper exterior seal, and a lower expander body having a generally cylindrical lower interior surface and at least one lower exterior seal, the lower expander having a first plurality of expander segments and a second plurality of expander segments, each of the second plurality of expander segments being spaced between adjacent first expander segments, and axially moveable relative to the first plurality of expander segments such that when the first and second plurality of expander segments are vertically aligned, the first and second expander segments together expand the lower expander body, and when the first expander segments are axially spaced from the second expander segments, the running tool may be retrieved to the surface through the central patch body;

providing the running tool including an inner mandrel axially moveable relative to the central patch body, one or more pistons axially moveable relative to the inner mandrel in response to fluid pressure within the running tool, a top expander axially moveable downward relative to the upper expander body in response to axial movement of the one or more pistons for radially expanding the upper expander body into sealing engagement with the downhole tubular string, and a bottom expander axially moveable upward relative to the lower expander body in response to axial movement of the one or more pistons for radially expanding the lower expander body into sealing engagement with the downhole tubular string, wherein the bottom expander includes an expander setting sleeve axially moved in response to the one or more pistons from a run-in position wherein the expander setting sleeve is axially spaced below the lower expander body to a set position wherein the expander setting sleeve is radially inward of and axially aligned with the lower expander body;

increasing fluid pressure within the running tool to move the one or more pistons which in turn moves the top expander and the bottom expander to expand the upper expander body and the lower expander body into sealing engagement with the tubular string; and thereafter withdrawing the running tool from the tubular patch supported on the tubular string.

18. A method as defined in claim 17, further comprising:

providing an upper set of slips on the upper expander body for gripping engagement with an inner surface of the tubular string; and providing a lower set of slips on the lower expander body for gripping engagement with the tubular string.

19. A method as defined in claim 17, further comprising:

interconnecting with the one or more pistons and the top expander with an outer sleeve; and interconnecting the outer sleeve and the work string with a shear member; and increasing fluid pressure to shear the shear member.

20. A method as defined in claim 17, further comprising:

providing an expansion joint between the upper expander body and the lower expander body for thermal expansion of the central patch body.

21. A method as defined in claim 17, further comprising:

providing a plurality of circumferentially spaced dogs each radially engaged to prevent downward movement of the upper expander body in response to the upper expander and upward movement of the lower expander body in response to the lower expander, and radially disengaged for retrieval from the upper expander body in response to axial movement of the inner mandrel; and biasing each of the plurality of dogs radially outward.

22. A method as defined in claim 17, wherein the expander setting sleeve remains downhole and radially supports the lower expander body when the running tool is returned to the surface.

23. A method as defined in claim 17, wherein the expander setting sleeve engages a stop shoulder on the lower expander body when moving to the set position.

24. A method as defined in claim 17, wherein the expander setting sleeve includes a plurality of axially spaced radially projecting exterior surfaces between axially spaced recessed exterior surfaces to reduce surface area of the expander setting sleeve and frictional forces during expanding of the lower expander body to the set position.

25. A method as defined in claim 17, wherein the top expander moves an upper expander setting sleeve axially downward in response to the one or more pistons from a run-in position wherein the expander setting sleeve is axially spaced above the upper expander body to a set position wherein the upper expander setting sleeve is radially inward of and axially aligned with the upper expander body.

26. A method as defined in claim 25, wherein the upper expander setting sleeve remains downhole and radially supports the upper expander body when the running tool is returned to the surface.

27. A system for forming a patch in a well at a location along a downhole tubular string which has lost sealing integrity, comprising:

a tubular patch for positioning within the downhole tubular string, the tubular patch being supported on a running tool suspended in the well from a work string;

the tubular patch including a central patch body having a generally cylindrical central interior surface, an upper expander body having a generally cylindrical upper interior surface and at least one upper exterior seal, and at least one lower expander body having a generally cylindrical lower interior surface and a lower exterior seal;

the running tool including an inner mandrel axially moveable relative to the central patch body, one or more pistons each axially moveable relative to the inner mandrel in response to fluid pressure within the running tool, a top expander axially moveable downward relative to the upper expander body in response to axial movement of the one or more pistons for radially expanding the upper expander body into sealing engagement with the downhole tubular string, and a bottom expander axially moveable upward relative to the lower expander body in response to axial movement of the one or more pistons for radially expanding the lower expander body into sealing engagement with the downhole tubular string, and for radially collapsing to withdraw the running tool from the well after expanding the lower expander body;

the bottom expander including an expander setting sleeve axially moveable in response to the one or more pistons from a run-in position wherein the expander setting sleeve is axially spaced below the lower expander body to a set position wherein the expander setting sleeve is radially inward of and axially aligned with the lower expander body; and the expander setting sleeve remains downhole and radially supports the lower expander body when the running tool is returned to the surface.

28. A system as defined in claim 27, wherein the expander setting sleeve engages a stop shoulder on the lower expander body when moving to the set position.

29. A system as defined in claim 27, wherein the expander setting sleeve includes a plurality of axially spaced radial projecting exterior surfaces between axially spaced recessed exterior surfaces, such that axially spaced portions of the lower expander body axially adjacent a projecting exterior surface are expanded more than portions of the lower expander body axially adjacent recessed exterior surfaces when the lower expander body is set.

30. A system as defined in claim 27, wherein the top expander moves an upper expander setting sleeve axially downward in response to the one or more pistons from a run-in position wherein the expander setting sleeve is axially spaced above the upper expander body to a set position wherein the upper expander setting sleeve is radially inward of and axially aligned with the upper expander body.

31. A system as defined in claim 30, wherein the upper expander setting sleeve remains downhole and radially supports the upper expander body when the running tool is returned to the surface.

32. A system for forming a patch in a well at a location along a downhole tubular string which has lost sealing integrity, comprising:

a tubular patch for positioning within the downhole tubular string, the tubular patch being supported on a running tool suspended in the well from a work string;

the tubular patch including a central patch body having a generally cylindrical central interior surface, an upper expander body having a generally cylindrical upper interior surface and at least one upper exterior seal, and a lower expander body having a generally cylindrical lower interior surface and at least one lower exterior seal;

the running tool including an inner mandrel axially moveable relative to the central patch body, one or more pistons axially moveable relative to the inner mandrel in response to fluid pressure within the running tool, a top expander axially moveable downward relative to the upper expander body in response to axial movement of the one or more pistons for radially expanding the upper expander body into sealing engagement with the downhole tubular string, a bottom expander axially moveable upward relative to the lower expander body in response to axial movement of the one or more pistons for radially expanding the upper expander body into sealing engagement with the downhole tubular string, and a plurality of circumferentially spaced dogs each radially engaged to prevent downward movement of the upper expander body in response to the upper expander and upward movement of the lower expander body in response to the lower expander and radially disengaged for retrieval from the upper expander body in response to axial movement of the inner mandrel;

the bottom expander including an expander setting sleeve axially moveable in response to the one or more pistons from a run-in position wherein the expander setting sleeve is axially spaced below the lower expander body to a set position wherein the expander setting sleeve is radially inward of and axially aligned with the lower expander body; and the expander setting sleeve remains downhole and radially supports the lower expander body when the running tool is returned to the surface.

33. A system as defined in claim 32, wherein the expander setting sleeve engages a stop shoulder on the lower expander body when moving to the set position.

34. A system as defined in claim 32, wherein the expander setting sleeve includes a plurality of axially spaced radial projecting exterior surfaces between axially spaced recessed exterior surfaces, such that axially spaced portions of the lower expander body axially adjacent a projecting exterior surface are expanded more than portions of the lower expander body axially adjacent recessed exterior surfaces when the lower expander body is set.

35. A system as defined in claim 32, wherein the top expander moves an upper expander setting sleeve axially downward in response to the one or more pistons from a run-in position wherein the expander setting sleeve is axially spaced above the upper expander body to a set position wherein the upper expander setting sleeve is radially inward of and axially aligned with the upper expander body.

36. A system as defined in claim 35, wherein the upper expander setting sleeve remains downhole and radially supports the upper expander body when the running tool is returned to the surface.

37. A method of forming a patch in a well at a location along a downhole tubular string which has lost sealing integrity, comprising:

positioning a tubular patch within the downhole tubular string at the location which has lost sealing integrity, the tubular patch being supported on a running tool suspended in the well from a work string;

providing the tubular patch with a central patch body having a generally cylindrical central interior surface, an upper expander body having a generally cylindrical upper interior surface and at least one upper exterior seal, and a lower expander body having a generally cylindrical lower interior surface and at least one lower exterior seal;

providing the running tool including an inner mandrel axially moveable relative to the central patch body, one or more pistons axially moveable relative to the inner mandrel, in response to fluid pressure within the running tool, a top expander axially moveable downward relative to the upper expander body in response to axial movement of the one or more pistons for radially expanding the upper expander body into sealing engagement with the downhole tubular string, and a bottom expander axially moveable upward relative to the lower expander body in response to axial movement of the one or more pistons for radially expanding the upper expander body into sealing engagement with the downhole tubular string, and for radially collapsing to withdraw the running tool from the well after expanding the lower expander body;

the bottom expander including an expander setting sleeve, the method including axially moving the bottom expander in response to the one or more pistons from a run-in position wherein the expander setting sleeve is axially spaced below the lower expander body to a set position wherein the expander setting sleeve is radially inward of and axially aligned with the lower expander body;

increasing fluid pressure within the running tool to move the one or more pistons which in turn moves the top expander and the bottom expander to expand the upper expander body and the lower expander body into sealing engagement with the tubular string;

thereafter withdrawing the running tool from the tubular patch supported on the tubular string; and the expander setting sleeve remaining downhole and radially supporting the lower expander body when the running tool is returned to the surface.

38. A system as defined in claim 37, wherein the expander setting sleeve engages a stop shoulder on the lower expander body when moving to the set position.

39. A system as defined in claim 37, wherein the expander setting sleeve includes a plurality of axially spaced radial projecting exterior surfaces between axially spaced recessed exterior surfaces, such that axially spaced portions of the lower expander body axially adjacent a projecting exterior surface are expanded more than portions of the lower expander body axially adjacent recessed exterior surfaces when the lower expander body is set.

40. A system as defined in claim 37, wherein the top expander moves an upper expander setting sleeve axially downward in response to the one or more pistons from a run-in position wherein the expander setting sleeve is axially spaced above the upper expander body to a set position wherein the upper expander setting sleeve is radially inward of and axially aligned with the upper expander body.

41. A system as defined in claim 40, wherein the upper expander setting sleeve remains downhole and radially supports the upper expander body when the running tool is returned to the surface.

* * * * *